US011421461B2

(12) United States Patent
Martin

(10) Patent No.: US 11,421,461 B2
(45) Date of Patent: Aug. 23, 2022

(54) SLIDING DOOR SOFT-CLOSER DEVICE

(71) Applicant: Anthony Innovations Pty Ltd, Thomastown (AU)

(72) Inventor: Ryan William Martin, Blackburn South (AU)

(73) Assignee: Anthony Innovations Pty Ltd, Thomastown (AU)

( * ) Notice: Subject to any disclaimer, the term of this patent is extended or adjusted under 35 U.S.C. 154(b) by 443 days.

(21) Appl. No.: 16/590,841

(22) Filed: Oct. 2, 2019

(65) Prior Publication Data

US 2020/0131831 A1 Apr. 30, 2020

(30) Foreign Application Priority Data

Oct. 15, 2018 (AU) ..... 2018903885
Sep. 12, 2019 (AU) ..... 2019229400

(51) Int. Cl.
*E05F 3/22* (2006.01)
*E05F 1/16* (2006.01)
*E05F 5/02* (2006.01)

(52) U.S. Cl.
CPC ..... *E05F 3/227* (2013.01); *E05F 1/16* (2013.01); *E05F 5/027* (2013.01); *E05Y 2900/132* (2013.01)

(58) Field of Classification Search
CPC ... E05F 1/16; E05F 5/027; E05F 3/227; E05F 5/003; E05F 3/00; E05F 3/02; E05F 2003/228; E05Y 2201/412; E05Y 2201/408; Y10T 16/56; Y10T 16/27
See application file for complete search history.

(56) References Cited

U.S. PATENT DOCUMENTS 4,656,781 A * 4/1987 Niekrasz ..... F25D 23/021 49/404
8,402,606 B1 * 3/2013 Tsai ..... E05F 3/18 16/49
9,009,918 B2 * 4/2015 Haab ..... E05D 15/0652 16/72
9,500,016 B2 * 11/2016 Wang ..... E05F 1/16
9,879,460 B2 * 1/2018 Nilsson ..... E05F 1/16
10,724,285 B2 * 7/2020 Dodge ..... E05F 1/16
2009/0096339 A1 * 4/2009 Worner ..... E05F 1/16 312/334.44
2011/0023370 A1 * 2/2011 Zimmer ..... E05F 5/003 49/360

(Continued)

FOREIGN PATENT DOCUMENTS

AU 2017101283 10/2017

*Primary Examiner* — Justin B Rephann
(74) *Attorney, Agent, or Firm* — Hanley, Flight & Zimmerman, LLC

(57) ABSTRACT

A soft-closer device has a housing installable in door rail, a roller and latch assembly in the housing and movable relative to the housing between first and second positions. A locking mechanism is adapted to secure the roller and latch assembly against movement to hold a sub-housing in a required position. The assembly includes a soft-closer actuator in the sub-housing operable to extend and contract, with latch mounted to project through and move along an opening of the housing as the actuator extends and contracts, and a journal on the sub-housing at which the roller is rotatable.

19 Claims, 3 Drawing Sheets

(56) References Cited

U.S. PATENT DOCUMENTS

| | | | | |
|---|---|---|---|---|
| 2013/0199099 | A1* | 8/2013 | Ryden | E05F 5/003 49/449 |
| 2015/0026928 | A1* | 1/2015 | Haab | E05F 1/16 16/96 R |
| 2016/0060935 | A1* | 3/2016 | Nilsson | E05D 15/0643 49/420 |
| 2016/0060936 | A1* | 3/2016 | Nilsson | E05D 15/0626 49/420 |
| 2017/0051548 | A1* | 2/2017 | Wang | E06B 3/4636 |
| 2018/0298666 | A1* | 10/2018 | Andersson | E05F 5/003 |
| 2019/0242168 | A1* | 8/2019 | Brun | E05D 15/0621 |

* cited by examiner

FIG 7
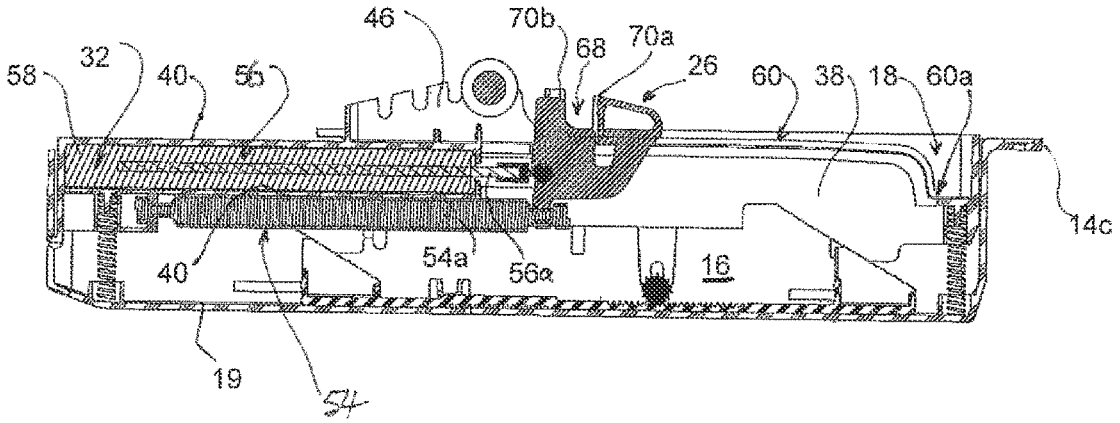
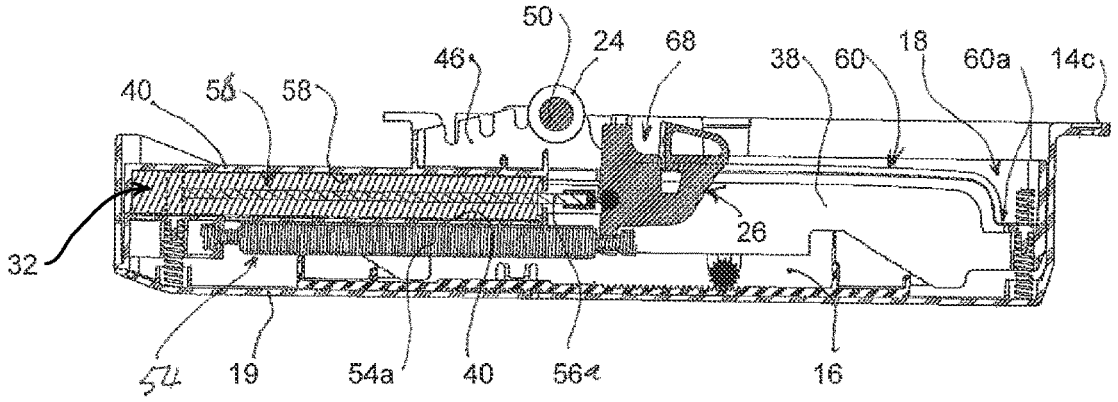
FIG 8

SLIDING DOOR SOFT-CLOSER DEVICE

FIELD OF THE INVENTION

This invention relates to a soft-closer device for a sliding door, in particular but not exclusively for a security sliding door, and to a sliding door fitted with a soft-closer device.

BACKGROUND TO THE INVENTION

Soft closers are commonly used to move drawers and cupboard doors in a controlled manner from a semi- or partially-open position to a closed position. They typically incorporate a piston, a latch and a return spring that cooperate to close the drawer or door at a consistent speed, whatever initial closing force or momentum is applied. An example is demonstrated in Australian Innovation Patent No. 2017101283 entitled "Sliding Panel Roller Support Assembly".

Security screen doors are commonly installed in homes to preventing unauthorised access, as they also enable ventilation. In many applications, such a screen is mounted on rollers to facilitate horizontal movement in the plane of a doorway in which the screen is installed. Doors of this type are secured in place with a conventional locking system that prevents horizontal movement of the door and thereby precludes access to the premises through the doorway.

In a typical security door, a respective set of rollers is installed at the top and bottom of the door to engage with a respective rail mounted on the top and bottom of the doorway. The degree of engagement between the rollers of each set and the corresponding rail is sufficient to prevent the door being moved at right angles to the plane of the door such as to enable unauthorised ingress. The rollers of each set must be adjustable in a vertical plane parallel to the door to allow the rollers to be retracted for installation, and then to be re-adjusted and locked into place to achieve vertical separation between the top and bottom sets of rollers and secure engagement of each set with the corresponding rail. With the rollers re-adjusted and locked in place, disengagement of the door from the rails is prevented and, for security purposes, the adjustment means must not be accessible from the doorways exterior.

The present invention seeks to provide a soft-closer device for a sliding door, such as a security sliding door, and to a sliding door with a fitted soft-closer device.

BROAD SUMMARY OF THE INVENTION

The soft-closer device primarily is intended for use in a particular orientation and, while other orientations are possible, it is convenient to describe the device in that specific orientation and with reference to a three-axis co-ordinate system having x- and y-axes in a horizontal plane and a vertical z-axis. The device is installable in a head rail of the frame of a sliding door which, relative to that system, has the head rail extending parallel to the x-axis, and the door installed in a door frame so as to slide, in opening and closing, in a plane parallel to the x- and z-axes.

According to the present invention, there is provide a soft-closer device for a sliding door, such as a security sliding door, wherein the device includes:

(A) an elongate housing that has opposite leading and trailing ends spaced parallel to the x-axis and that defines an elongate opening extending intermediate of the opposite ends along the x-axis, with the housing adapted to be installed in an elongate opening in, and along, a top surface of a head rail of the door such that opposite ends of the housing are spaced along the head rail and the opening is adjacent to the top surface, with the leading end and the trailing end respectively leading and trailing in movement of the door to close a doorway in which the door is installed;

(B) a roller and latch assembly mounted in the housing and movable relative to the housing, parallel to the z-axis, between a first position in which a roller and a latch of the assembly are adjacent to the opening of the housing and towards which the assembly is resiliently biased, and a second position in which the assembly is retracted from the opening; and (C) a locking mechanism adapted to secure the roller and latch assembly against movement relative to the housing parallel to the z-axis and thereby hold the sub-housing in a required position relative to the housing; and wherein the roller and latch assembly includes:

(i) an elongate sub-housing in which the roller and latch are contained and spaced parallel to the x-axis;

(ii) a soft-closer actuator mounted in the sub-housing and operable to extend and contract substantially parallel to the x-axis, with latch mounted on the actuator so as to project through the opening and to move along the opening as the actuator extends and contracts; and (iii) a journal on the sub-housing at which the roller is rotatable on an axis parallel to the y-axis.

The present invention also provides a sliding door fitted with the soft-closer device of the invention, wherein the door has a top member extending between first and second sides of the door that respectively lead and trail as the door closes; the top member defines a recess that opens to and extends down from a top surface of the head rail, adjacent to the first side, and the soft-closer device is accommodated in the recess with the opening of the housing adjacent to the top surface of the head rail and the opposite ends of the housing spaced along the top surface of the top rail; and wherein the sub-housing is able to be positioned and secured by the locking mechanism in a position placing the roller for rolling engagement with a rail extending across the head of a doorway in which the door is to be installed and in which the latch projects through the opening to enable the latch to engage with a strike plate mounted at the head of the doorway to provide soft closing of the door under the action of the soft-closer actuator.

Thus, in broad terms, the present invention provides a soft-closure device for a sliding door that incorporates one of the rollers of the set of rollers required at the top or "head" of a security door.

The soft-closer actuator most conveniently has a return spring operable to draw the door to a closed position relative to a doorway in which the door is installed. The engagement of the strike plate and the latch enables the return spring to draw the door towards the closed position. If the latch is positioned too high relative to the rail, a collision could occur between the latch and rail whereas, if the latch is positioned too low, there will be insufficient engagement between the latch and strike plate for reliable operation.

An advantage of the soft-closer device of the invention is that the latch height is adjustable in concert with the roller, until the roller is positioned to contact the rail extending across the head of the doorway. An appropriate vertical offset parallel to the z-axis between latch the roller automatically provides the correct degree of engagement between latch and strike plate, with the strike plate correctly positioned.

The sub-housing may be resiliently biased towards the first position in a number of different ways, such as by a compression spring arrangement. Preferably two or more compression springs, acting parallel to the z-axis and spaced along the x-axis, are provided between housing and the sub-housing. This arrangement serves to ensure the roller engages with the track before manual height adjustment of the locking feature is completed, while the arrangement also facilitates assembly of the soft-closer device.

The housing most conveniently is U-shaped in transverse cross-sections between the opposite ends. The housing preferably is of narrow form, with opposed, elongate sidewalls that are relatively closely spaced and joined at respective edges further from the elongate opening by a base wall. The sub-housing most conveniently is of similar narrow form defined by opposed elongate side walls that are maintained in spaced relationship by cross-connectors, with the sub-housing having leading and trailing ends respectively adjacent to the leading and trailing ends of the housing. In any event, one of the housing and the sub-housing preferably has projections on one or each of the respective sidewalls that are spaced parallel to the x-axis, with each projection keying into a respective slot extending parallel to the z-axis that is defined in one or each side wall side wall of the other one of the housing and sub-housing.

The relative narrow form enables the soft-closer device to be accommodated in a top member of the door without compromising the strength and integrity of the door. In the case of a door with a timber frame, the recess in which the device is accommodated is able to be in the form of a narrow stub mortice within ample timber to avoid compromising the frame. In the case of a metal frame, such as of generally narrow, extruded hollow profiles of steel or aluminium alloy, the recess is able to be formed by cutting a narrow slot in the profile which again does not significantly weaken the frame to guide and constrain the sub-housing in movement along the z-axis relative to the housing.

At a longitudinal edge of each sidewall of the sub-housing nearer to the elongate opening of the housing, there may be a respective one of an opposed pair of projecting flange formations in each of which is journaled an axle on which the roller is rotatable. An interconnecting web may brace and strengthen the flange formations. The flange formations and the roller between them most preferably are located so as to be spaced from each end of the sub-housing and, hence from each of the leading and trailing end of the sub-housing. With such spacing, the latch preferably is located and movable between the flange formations and the leading end, with the soft-closer actuator having a spring housing mounted between the sidewalls of the sub-housing and extending between the trailing end of the sub-housing and the flange formations, with a rod of the actuator to which the latch is connected being extendible towards and retractable from of the leading end of the sub-housing. The actuator may be accommodated in an elongate pocket accessible through an elongate opening along one of the sidewalls of the sub-housing. Also, the latch may be guided in movement, with extension and retraction of the actuator, by a guideway defined by one or each of the sidewalls of the sub-housing.

The locking mechanism adapted to secure the roller and latch assembly against movement relative to the housing parallel to the z-axis and thereby hold the sub-housing in a required position relative to the housing can take a variety of forms. In one preferred form a first set of ramps is positioned in the housing between the base wall of the housing and the sub-housing, with each ramp of the first set co-operable with a respective ramp of a second set of similar, but inverted ramps. The ramps of each set are spaced along the x-axis, with ramp surfaces that are inclined with respect to the x- and z-axes at a common angle, such as from about 25° to 35° and most preferably about 30°. The ramps of the first set are movable in unison parallel to the x-axis and the ramps of the second set fixed relative to the sub-housing and either mounted on or defined by the sub-housing. The ramps of the first set may be movable in unison by being mounted on a common locking bar, such as with each ramp of the first set at a respective end of the bar. When the ramps of the first set are adjusted parallel to the x-axis, such as by longitudinal adjustment of the locking bar, the ramp surfaces of the ramps of the first set are moved relative to the ramps of the second set, causing ramp surfaces of the first set to move over and against each other, thereby pushing the sub-housing towards the opening of the housing and advancing the roller parallel to the z-axis to correspondingly advance the roller until it contacts the rail. The separation of the ramps of each set along the x-axis ensures the roller and latch assembly remains parallel with the opening of the and, hence, with the head rail of a door in which the soft-closer device is installed. This is important to maintain the correct degree of engagement between latch and strike plate, throughout the doors range of travel. In addition to its use during assembly, this adjustment provides the added benefit of ensuring secure engagement is achieved when the clearance along the z-axis between doorframe and door varies between individual installations.

Space in the interface between the door and frame is generally constrained, so it is desirable that the soft-closer device is contained within the doorframe itself, which provides the further advantage of being less visually obtrusive. The shape of the housing of the device minimises the aperture required in the frame for insertion, substantially reducing the inherent loss mechanical strength necessarily created by such an aperture. Given installation of the device within the doorframe, the height of the smallest common frame constrains the maximum height of the housing, which includes provision for vertical adjustment of the roller along the z-axis, as previously described. To provide a greater range of vertical adjustment than can be contained within the device, provision can be made for a number of roller journals in the roller and latch mechanism, which extends above the housing/frame. Each of two or more roller journals provides a different height offset between mechanism and roller, effectively extending the adjustment range. This makes the product suitable for applications where the distance between door and doorway is greater than the frame height.

GENERAL DESCRIPTION OF THE DRAWINGS

In order that the invention may more readily be understood, description now is directed to the accompanying drawings, in which.

Figure 5:
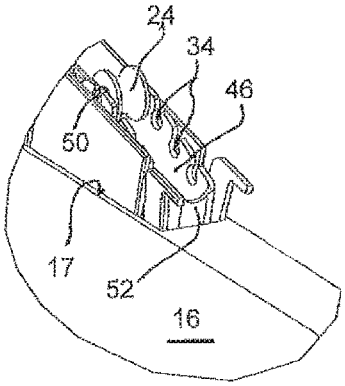
Figure 1:
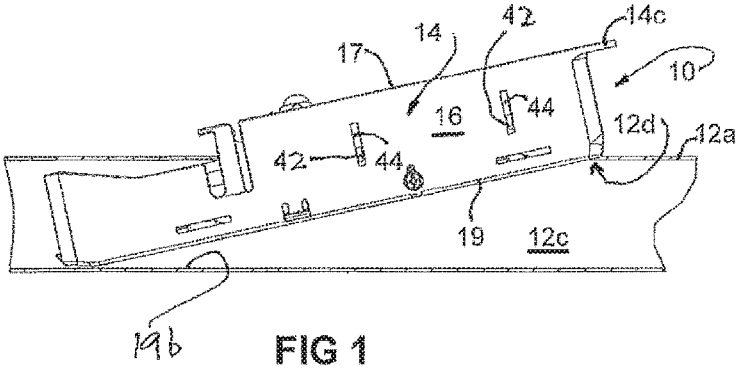
FIG. 1 is a side elevation of a soft-closer device according to the invention, in the course of being installed.
Figure 6:
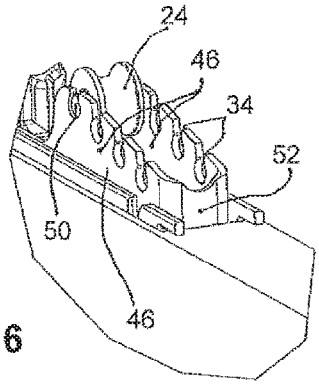
Figure 3:
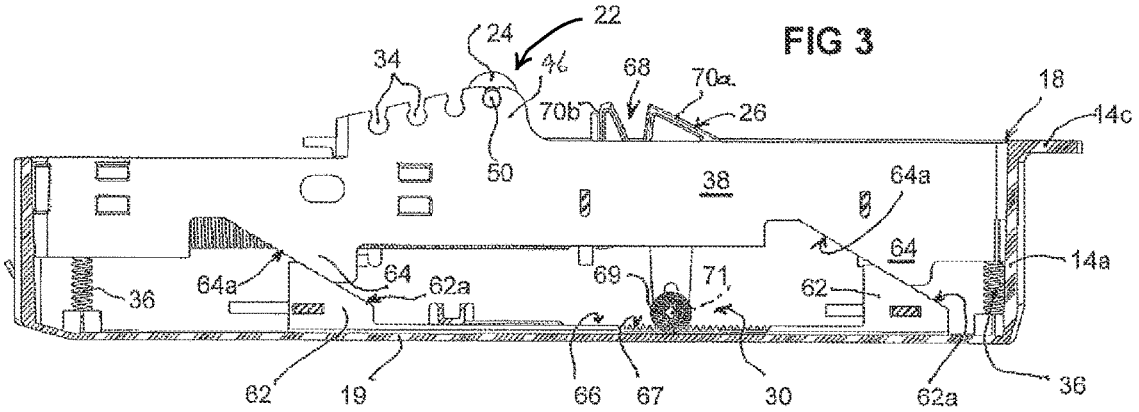
FIG. 3 shows a partial sectional view of the device of FIG. 1 in a first condition.
Figure 4:
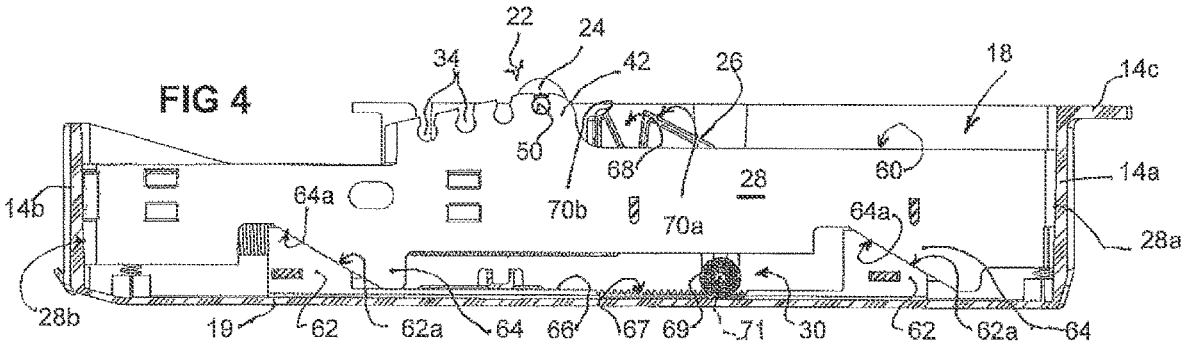

FIG. 4 corresponds to FIG. 3, but with the device in a second condition;

FIG. 5 shows a perspective view, on an enlarged scale, of part of the device of FIG. 1 in the first condition shown in FIG. 3;

FIG. 6 corresponds to FIG. 5, but relates to the device in the second condition of FIG. 4;

FIG. 7 corresponds to FIG. 3, with the device of FIG. 1 in or close to the first condition but with the sectional view taken on a central longitudinal plane of the device; and FIG. 8 corresponds to FIG. 7, but with the device shown in or close to the second condition shown in FIG. 4.

DETAILED DESCRIPTION OF THE DRAWINGS

Figure 2:
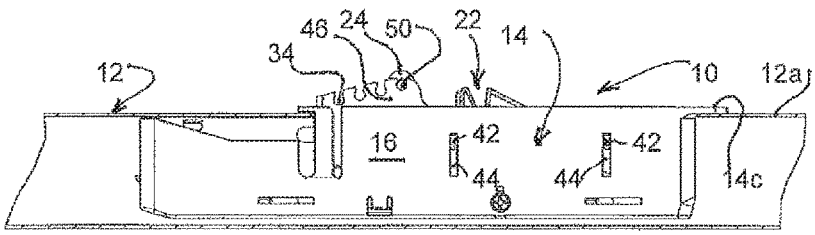
FIG. 2 shows the device of FIG. 1 as installed.

With reference to the Figures, there is shown a soft-closer device 10 for a sliding door, such as a security sliding door. In FIGS. 1 and 2, the door is represented only by illustration of a head rail 12 which, in this instance, comprises an extruded metal section defining top wall 12*a*, bottom wall 12*b* and opposed sidewalls 12*c*. Only the far sidewall 12*c* is shown, as the nearside sidewall has been cut away for ease of illustration of device 10. In FIG. 1, device 10 is shown as presented to the rail 12 in the course of device being installed, while FIG. 2 shows device 10 fully installed by being passed endwise through opening 12*d* in the top wall 12*a* of head rail 12. In the following, description is with reference to a three axis coordinate system having x- and y-axes in a horizontal plane and a vertical z-axis of which the x-axis extends horizontally left-and-right in FIGS. 1 to 4, 7 and 8; the y-axis is perpendicular to the plane of those Figures; and the z-axis is perpendicular to the horizontal x-y plane and so extends between the top and bottom of those Figures. The device is installed with head rail 12 part of the frame of a sliding door fitted to a door frame such that, relative to that system, has the head rail 12 extends parallel to the x-axis, and the door is able to slide, in opening and closing, in a plane parallel to the x- and z-axes. Relative to the illustrated arrangement, the door slides to the right and left, respectively, in closing and opening.

The device 10 has an elongate housing 14 that has parallel sidewalls 16 spaced along the y-axis and extending parallel to the x-axis between opposite ends, comprising a leading end 14*a* and a trailing end 14*b*. The walls 16 have opposed longitudinal edges spaced along the z-axis, comprising upper edges 17 that define an elongate opening 18 (shown most clearly in FIG. 8) extending intermediate of the opposite ends 14*a* and 14*b* along the x-axis and lower edges that are joined by an elongate base wall 19 of housing 14. The housing is adapted to be installed endwise through an elongate opening 20 in, and along, the top surface 12*a* of head rail 12 to position the device 10 fully within rail 12, apart from a tab 14*c* that projects beyond end 14*a* of housing 14 and enables securement of device 10 by a fastener applied through tab 14*c*, into top wall 12*a* of rail 12. Thus, the opposite ends 14*a* and 14*b* of the housing 14 are spaced along the head rail 12 and the opening 20 of housing 14 is adjacent to the top surface of rail 12 with, as indicated, the leading end and the trailing end respectively leading and trailing in movement of the door to close a doorway in which it is installed.

The device 10 has a roller and latch assembly 22 mounted in the housing 14 and movable relative to the housing 14, parallel to the z-axis, between a first position shown in FIG. 3 in which a roller 24 and a latch 26 of the assembly 22 are adjacent to the opening 18 of the housing 14, and a second position shown in FIG. 4 in which the assembly 22 is retracted from the opening. The assembly 22 is resiliently biased towards the first position, and includes an elongate sub-housing 28 in which the roller 24 and latch 26 are contained and spaced parallel to the x-axis. The device 10 also includes a locking mechanism 30 adapted to secure the roller and latch assembly 22 against movement relative to the housing 14 parallel to the z-axis and thereby hold the assembly 22 in a required position in and relative to the housing. The assembly also includes a soft-closer actuator 32 (seen in FIGS. 7 and 8) mounted in the sub-housing 28 and operable to extend and contract substantially parallel to the x-axis, with the latch 26 mounted on the actuator so as to project through the opening 18 and to move along the opening 18 as the actuator 32 extends and contracts. Additionally, the roller is rotatable on an axis parallel to the y-axis on a journal 34 provided on the sub-housing 28.

The soft-closer actuator 32 most conveniently has a return spring operable to draw the rail 12, and a door of which rail forms part, to a closed position relative to a doorway in which the door is installed. The engagement of a strike plate, mounted at the top of the doorway, and the latch 26 enables the return spring to draw the door towards the closed position. If the latch extends too far towards the rail, a collision could occur between the latch and rail whereas, if the latch is positioned too far away from the rail, there will be insufficient engagement between the latch and strike plate for reliable operation. An advantage of the soft-closer device of the invention is that the latch height is adjustable in concert with the roller, until the roller is positioned to contact the rail extending across the head of the doorway. An appropriate vertical offset parallel to the z-axis between latch the roller automatically provides the correct degree of engagement between latch and strike plate, with the strike plate correctly positioned.

The sub-housing 28, and hence the assembly 22, is resiliently biased towards the first position in a number of different ways, such as by a compression spring arrangement. In the illustrated arrangement, two compression springs 36, acting parallel to the z-axis and spaced along the x-axis, are provided between housing base wall 19 of housing 14 and the sub-housing 28 of assembly 22. This arrangement serves to ensure the roller 24 engages with a track mounted across the top of the doorframe before manual height adjustment of the locking mechanism 30 is completed, while the arrangement also facilitates assembly of the soft-closer device.

The housing 14 most conveniently is U-shaped in transverse cross-sections between the opposite ends 14*a* and 14*b*. The housing 14 also preferably is of narrow form, with the opposed, elongate sidewalls 16 relatively closely spaced and joined at respective edges further from the elongate opening 18 by the base wall 19. The sub-housing 28 most conveniently is of similar narrow form defined by opposed elongate sidewalls 38 that are maintained in spaced relationship by cross-connectors 40 (see FIGS. 7 and 8), with the sub-housing 28 having a leading end 28*a* and a trailing end 28*b* respectively adjacent to the leading end 14*a* and trailing end 14*b* of the housing 14. In any event, the sub-housing 28 has projections 42 on the outer surface one or each of the sidewalls 38 that are spaced parallel to the x-axis, with each projection 42 keying into a respective slot 44 extending parallel to the z-axis defined in one or each side-wall of the housing 14. The relative narrow form for each of housing 14 and sub-housing 28, and the short length along the x-axis of the aperture to receive the soft-closer device 10, enables the device 10 to be accommodated in a top member of the door without compromising the strength and integrity of the door.

At a longitudinal edge of each sidewall 38 of the sub-housing 28 nearer to the elongate opening 18 of the housing 14, there is a respective one of an opposed pair of projecting flange formations 46. Each of formation 46 defines at least one journal 34 in which is located an axle 50 on which the roller 24 is rotatable. The flange formations 46 are braced and strengthened by an interconnecting web 52. The flange formations 46 and the roller 24 between them are located so as to be spaced from each of the ends 28*a*, 28*b* of sub-housing 28 and, hence from each of the leading and trailing ends 14*a*, 14*b* of the housing 14. With such spacing, the latch 26 is located and movable between the flange formations 46 and the leading end 28*a*, with the soft-closer actuator 32, comprising a piston device 56 and spring housing 54. A rod 56*a* of piston device 56 is extendible against a tension spring 54*a* within spring housing 54, with the actuator mounted between the sidewalls 38 of the sub-housing 28 and extending between the trailing end 28*b* of the sub-housing 28 and the flange formations 46. The rod 56*a* is connected to the latch 26 and is extendible towards and retractable from the leading end 28*a* of the sub-housing 28 for corresponding movement of the latch 26. The actuator 32 is accommodated in an elongate pocket 58 accessible through an elongate opening along one of the sidewalls 38 of the sub-housing 28 and bounded by the other sidewall 38 and upper and lower connectors 40 joining the two sidewalls 38. Also, the latch 26 is guided in movement, with extension and retraction of the actuator 32, by a guideway 60 defined by one or each of the sidewalls 38 of the sub-housing 28. The guideway 60 extends parallel to the x-axis over a major part of its length from adjacent to the roller 24 to just short of the end 28*a* of sub-housing 28, with an end portion 60*a* adjacent to end 28*a* curving away from the opening 18.

The locking mechanism 30 adapted to secure the roller and latch assembly 22 against movement relative to the housing 14 parallel to the z-axis and thereby hold the sub-housing 28 in a required position relative to the housing 14 can take a variety of forms. In the illustrated form, the mechanism 30 includes a first set of ramps 62 positioned in the housing 14 between the base wall 19 of the housing 14 and the sub-housing 28, and a second set of similar, but inverted ramps 64, with each ramp 62 of the first set co-operable with a respective ramp 64. The ramps 62 and 64 of each set are spaced along the x-axis, with ramp surfaces 62*a* and 64*a* that are inclined with respect to the x- and z-axes at a common angle of about 30°. The ramps 62 of the first set are movable in unison parallel to the x-axis and the ramps of the second set fixed relative to the sub-housing 28 and either mounted on or defined by the sub-housing. The ramps 62 of the first set are movable in unison by being mounted of a common locking bar 66, with each ramp 62 at a respective end of the bar 66. When the ramps 62 are adjusted parallel to the x-axis, by longitudinal adjustment of the locking bar 66, the ramp surfaces 62*a* of the ramps 62 are moved relative to the ramps 64 of the second set, causing ramp surfaces 62*a* to move over and against the ramp surfaces 64*a*, thereby pushing the sub-housing 28, and hence the assembly 22, towards the opening 18 of the housing 14 and advancing the roller 24 parallel to the z-axis to correspondingly advance the roller 24 until it contacts the rail against which it is to run. The separation of the ramps of each set parallel to the x-axis ensures the roller and latch assembly 22 remains parallel with the opening 18 of the housing 14 and, hence, with the head rail 12 of a door in which the soft-closer device 10 is installed. This is important to maintain the correct degree of engagement between latch 26 and strike plate, throughout the travel range for the door. In addition to its use during assembly, this adjustment provides the added benefit of ensuring secure engagement is achieved when the clearance along the z-axis between doorframe and door varies between individual installations.

The locking mechanism 30 enables the ramps 62 of the first set to move in unison for relative movement between housing 14 and the assembly 22, and also to hold the housing 14 and the assembly 22 in a required relative setting. To enable this, the locking bar 66 is provided along its length parallel to the x-axis with a series 67 of transverse teeth, while a gear wheel 69 rotatable on an axle 71 parallel to the y-axis meshes with the teeth of the locking bar 66 for advancing or retracting the bar 66 endwise, substantially parallel to the x-axis. The outer end of the gear wheel 69 can be engaged by a hand tool for rotating the gear wheel 69, and for locking the wheel 69 when a required adjustment setting between housing 14 and assembly 22 is achieved. To assist in retaining a required setting, the opposed, inclined surfaces 62*a* and 64*a* of the ramps of the respective sets are provided with fine steps that, in effect, provide a light interlocking of the surfaces 62*a* and 64*a*. Also, the locking bar 66 is firmly held between base 19 of housing 14 and the toothed gear wheel 69 to ensure positive engagement is maintained. Thus, the locking bar 66 is confined between the base wall 19 of the housing 14 and the gear wheel 69, to ensure maintenance of meshing engagement under load between the gear wheel 69 and the transverse teeth along the locking bar 66.

To provide a greater range of vertical adjustment than can be contained within the device 10, a number of roller journals 34 are provided in the roller and latch mechanism 22 rather than just one journal 34. As seen most clearly in FIGS. 5 and 6, four roller journals are shown, although more or less (down to one) may be provided, with each of a number of journals 34 providing a different height offsets between the housing 14 and roller 24, effectively extending the adjustment range by varying the aligned journals 34 in the opposed pair of projecting flange formations 46 in which the roller 24 is rotatable. This makes the product suitable for applications where the distance between door and doorway is greater than the frame height.

Engagement between the latch 26 and a strike plate is by a depending tab of the strike plate locating in an upwardly opening notch 68 defined between a pair of upstanding fingers comprising a leading finger 70*a* and a trailing finger 70*b*, with fingers 70*a* and 70*b* spaced along the x-axis. With the tab of the strike plate located in notch 68, the latch is held against movement during an initial stage of movement of the door to open, by the tab of the strike plate engaging leading finger 70*a*, resulting in rod 56 being drawn from piston 54. Similarly, with a final stage of movement of the door to close, the tab of the latch bears against trailing finger 70*b*, causing the rod 56 to be retracted back into piston by a spring tension provided in or by actuator 32. However, after the initial movement of the door to open and before the final movement to close, the tab of the latch first disengages from the latch and thereafter re-engages with the latch. To enable this, the latch is pivotally engaged with the end of rod 56 of actuator 32 such that, as the latch is moved to section 60*a* of the guideway 60 as the door opens, the latch tilts clockwise in the views of FIGS. 3 and 4, so finger 70*a* retracts relative to finger 70*b* and the tab of the strike plate is able to move out of notch 68. Conversely, as the door closes, the tab of the strike plate contacts the finger 70*b*, causing the latch 26 to be drawn from section 60*a* of the guideway 60 by the latch 26 tilting anti-clockwise in the views of FIGS. 3 and 4, such that the tab of the strike plate again is retained in notch 68 and enables the latch 26 to be drawn back along the guideway 60 as the rod retracts into piston 54 by tension spring 54*a*.

The invention claimed is:

1. A soft-closer device for a sliding door, wherein the device is installable in a head rail of a frame of the sliding door which, relative to a three-axis co-ordinate system, has the head rail extending parallel to a horizontally extending x-axis, the device comprising:

an elongate housing that has opposite leading and trailing ends and that defines an elongate opening extending intermediate of the opposite ends, the housing adapted to be installed in an elongate recess in, and along, a top surface of the head rail of the door such that the opposite ends of the housing are spaced along the head rail parallel to the x-axis and the elongate opening of the housing is adjacent to the top surface of the head rail, with the leading end and the trailing end respectively leading and trailing in movement of the door to close a doorway in which the door is installed;

an elongate sub-housing that is contained within the elongate housing and that, relative to said movement, has opposite leading and trailing ends spaced parallel to spacing between the opposite ends of the housing with each of the leading end and the trailing end of the sub-housing respectively facing the leading end and the trailing end of the elongate housing;

a roller and latch assembly mounted in the elongate housing, the roller and latch assembly contained in the sub-housing and movable relative to the housing, parallel to an upstanding z-axis perpendicular to the x-axis, between a first position in which a roller and a latch of the assembly are adjacent to the opening of the elongate housing and towards which the roller and latch assembly is resiliently biased, and a second position in which the roller and latch assembly is retracted from the opening, the roller and the latch spaced in the sub-housing parallel to the x-axis; and a locking mechanism adapted to secure the roller and latch assembly against movement relative to the elongate housing parallel to the z-axis and thereby hold the sub-housing in a required position relative to the elongate housing; and wherein the roller and latch assembly includes:

(i) a soft-closer actuator mounted in the sub-housing and operable to extend and contract substantially parallel to the x-axis, with the latch mounted on the actuator so as to project through the elongate opening and to move along the elongate opening as the actuator extends and contracts; and (ii) a journal on the sub-housing at which the roller is rotatable on an axis parallel to a horizontally extending y-axis perpendicular to the x- and z-axes.

2. The soft-closer device of claim 1, wherein the soft-closer actuator has a return spring operable to draw the door to a closed position relative to the doorway in which the door is installed, and engagement of a strike plate mounted at a head beam of the doorway and the latch enables the return spring to draw the door towards the closed position.

3. The soft-closer device of claim 1, wherein a height of the latch is adjustable in concert with the roller, until the roller is positioned to contact a head beam extending across a head of the doorway, such that a vertical offset parallel to the z-axis between the latch and the roller enables a correct degree of engagement between the latch and a strike plate mounted at the head beam of the doorway.

4. The soft-closer device of claim 1, wherein the sub-housing is resiliently biased towards the first position by at least two compression springs acting parallel to the z-axis and spaced along the x-axis between the elongate housing and the sub-housing.

5. The soft-closer device of claim 1, wherein the elongate housing is U-shaped in transverse cross-sections between the opposite ends, with opposed, elongate sidewalls that are relatively closely spaced and joined at respective edges further from the elongate opening by a base wall.

6. The soft-closer device of claim 5, wherein the sub-housing is of a form defined by opposed elongate sidewalls that are maintained in spaced relationship by cross-connectors, with the leading end and the trailing end of the sub-housing respectively adjacent to the leading end and the trailing end of the elongate housing.

7. The soft-closer device of claim 6, wherein one of the elongate housing and the sub-housing has projections on one or each of the respective sidewalls, the projections being spaced parallel to the x-axis, with each projection keying into a respective slot extending parallel to the z-axis that is defined in one or each sidewall of the other one of the housing and the sub-housing.

8. The soft-closer device of claim 6, wherein at a longitudinal edge of each sidewall of the sub-housing nearer to the elongate opening of the housing, there is a respective one of an opposed pair of projecting flange formations in each of which is journaled an axle on which the roller is rotatable.

9. The soft-closer device of claim 8, wherein the flange formations and the roller between them are located so as to be spaced from each end of the sub-housing and, hence from each of the leading and trailing end of the sub-housing.

10. The soft-closer device of claim 9, wherein the latch is located and movable between the flange formations and the leading end of the sub-housing, with the soft-closer actuator having a spring housing mounted between the sidewalls of the sub-housing and extending between the trailing end of the sub-housing and the flange formations, with a rod of the actuator to which the latch is connected being extendible towards and retractable from the leading end of the sub-housing.

11. The soft-closer device of claim 10, wherein the actuator is accommodated in an elongate pocket accessible through an elongate opening along one of the sidewalls of the sub-housing, with the latch guided in movement, with extension and retraction of the actuator, by a guideway defined by one or each of the sidewalls of the sub-housing.

12. The soft-closer device of claim 1, wherein the locking mechanism includes a first set of ramps positioned in the housing between a base wall of the housing and the sub-housing, with each ramp of the first set co-operable with a respective ramp of a second set of similar, but inverted ramps, with the ramps of each set spaced along the x-axis.

13. The soft-closer device of claim 12, wherein each ramp of each set has a ramp surface inclined with respect to the x- and z- axes at a common angle of from 25° to 35°.

14. The soft-closer device of claim 13, wherein the ramps of the first set are movable in unison parallel to the x-axis and the ramps of the second set fixed relative to the sub-housing and either mounted on or defined by the sub-housing, with the ramps of the first set movable in unison by being mounted of a common locking bar whereby when the ramps of the first set are adjusted parallel to the x-axis by longitudinal adjustment of the locking bar, the ramp surfaces of the ramps of the first set are moved relative to the ramps of the second set, causing ramp surfaces of the first set to move over and against each other, thereby pushing the sub-housing towards the opening of the housing and advancing the roller parallel to the z-axis to correspondingly advance the roller until it contacts a head beam of the doorway, or allowing the sub-housing and the roller to retract from the opening, depending on a direction of movement of the ramps of the first set.

15. The soft-closer device of claim 14, wherein the ramps of each set are separated along the x-axis thereby to ensure the roller and latch assembly remains parallel with the opening of the housing and, hence, with the head rail of the door in which the soft-closer device is installed.

16. The soft-closer device of claim 14, wherein the locking bar is confined between the base wall of the housing and a gear wheel, to ensure maintenance of meshing engagement under load between the gear wheel and transverse teeth along the locking bar.

17. The soft-closer device of claim 1, wherein the sub-housing has an opposed pair of projecting flange formations in each of which is journaled an axle on which the roller is rotatable, with the flange formations braced and strengthened by an interconnecting web, with the formations having two or more roller journals providing different height offsets between the sub-housing and the roller, effectively extending an adjustment range.

18. The soft-closer device of claim 1, wherein the housing is adapted to fit substantially within the head rail of the door in a manner reducing a required length of aperture along the x-axis and thereby reduces compromising a mechanical strength of the door.

19. A sliding door fitted with the soft-closer device according to claim 1, wherein the door has a top member extending between first and second sides of the door that respectively lead and trail as the door closes; the top member includes the head rail of the door and defines the elongate recess that opens to and extends down from the top surface of the head rail, adjacent to the first side of the door, and the soft-closer device is accommodated in the recess with the opening of the housing adjacent to the top surface of the head rail and the opposite ends of the housing spaced along the top surface of the head rail; and wherein the sub-housing is able to be positioned and secured by the locking mechanism in a position placing the roller for rolling engagement with a rail extending across a head of the doorway in which the door is to be installed and in which the latch projects through the opening to enable the latch to engage with a strike plate mounted at the head of the doorway to enable soft closing of the door under action of the soft-closer actuator.

* * * * *